US010787918B2

(12) United States Patent
Marlow et al.

(10) Patent No.: US 10,787,918 B2
(45) Date of Patent: Sep. 29, 2020

(54) GAS TURBINE TRANSITION DUCT

(71) Applicant: ANSALDO ENERGIA SWITZERLAND AG, Baden (CH)

(72) Inventors: Paul Marlow, Baden (CH); Michael Maurer, Bad Säckingen (DE); Dalibor Vrbetic, Karlovac (HR)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 368 days.

(21) Appl. No.: 15/680,378

(22) Filed: Aug. 18, 2017

(65) Prior Publication Data

US 2018/0051578 A1 Feb. 22, 2018

(30) Foreign Application Priority Data

Aug. 22, 2016 (EP) ..... 16185198

(51) Int. Cl.
*F01D 9/02* (2006.01)
*F23R 3/42* (2006.01)
(Continued)

(52) U.S. Cl.
CPC ..... *F01D 9/023* (2013.01); *F01D 25/12* (2013.01); *F23R 3/002* (2013.01); *F23R 3/42* (2013.01);
(Continued)

(58) Field of Classification Search
CPC ..... F01D 9/023; F01D 25/12; F23R 3/002; F23R 3/04; F23R 3/07; F23R 3/02;
(Continued)

(56) References Cited

U.S. PATENT DOCUMENTS 4,872,312 A * 10/1989 Iizuka ..... F01D 9/023 60/760
6,718,774 B2 * 4/2004 Razzell ..... F01D 25/243 60/753
(Continued)

FOREIGN PATENT DOCUMENTS

EP 2 206 886 A2 7/2010
JP H 10-82527 A 3/1998

OTHER PUBLICATIONS

European Search Report dated Jan. 31, 2017.

*Primary Examiner* — Ehud Gartenberg
*Assistant Examiner* — David P. Olynick
(74) *Attorney, Agent, or Firm* — Buchanan Ingersoll & Rooney PC

(57) ABSTRACT

A gas turbine transition duct includes: an inner tubular body, defining a transition channel and having a first upstream end and a first downstream end for coupling to a can combustor and to a turbine section of a gas turbine assembly, respectively; an outer tubular body, arranged around the inner tubular body and having a second upstream end at the first upstream end of the inner tubular body and a second downstream end at the first downstream end of the inner tubular body; wherein a convective cooling channel is defined between the inner tubular body and the outer tubular body, the convective cooling channel having an inlet between the first downstream end and the second downstream end; and wherein the outer tubular body is continuous between the second upstream end and the second downstream end.

10 Claims, 5 Drawing Sheets

(51) Int. Cl.
*F01D 25/12* (2006.01)
*F23R 3/00* (2006.01)

(52) U.S. Cl.
CPC ..... *F05D 2260/20* (2013.01); *F23R 2900/03043* (2013.01)

(58) Field of Classification Search
CPC ..... F23R 3/46; F23R 3/14; F23R 3/16; F23R 3/42; F23R 3/60; F23M 5/04; F23M 5/08; F23M 5/085; F23M 9/02
See application file for complete search history.

(56) References Cited

U.S. PATENT DOCUMENTS

| | | | | |
|---|---|---|---|---|
| 8,158,428 | B1 * | 4/2012 | Krishna | G01N 25/72 250/339.14 |
| 2010/0170259 | A1 | 7/2010 | Huffman | |
| 2010/0199677 | A1 * | 8/2010 | Figueroa | F01D 9/023 60/752 |
| 2011/0214429 | A1 * | 9/2011 | Chen | F23R 3/005 60/755 |
| 2011/0247339 | A1 * | 10/2011 | Chila | F23R 3/02 60/752 |
| 2012/0198855 | A1 * | 8/2012 | Cihlar | F01D 9/023 60/760 |
| 2012/0234018 | A1 * | 9/2012 | Cihlar | F01D 9/023 60/796 |
| 2013/0255276 | A1 * | 10/2013 | Jorgensen | F02C 7/20 60/796 |
| 2014/0223921 | A1 | 8/2014 | Tschuor et al. | |
| 2017/0268776 | A1 * | 9/2017 | Willis | F02C 3/04 |

* cited by examiner

GAS TURBINE TRANSITION DUCT

PRIORITY CLAIM

This application claims priority from European Patent Application No. 16185198.5 filed on Aug. 22, 2016, the disclosure of which is incorporated by reference.

TECHNICAL FIELD

The present invention relates to a gas turbine transition duct.

BACKGROUND

As is known, a can-combustor gas turbine assembly comprises a compressor section, a combustor assembly, that includes a plurality of can combustors arranged circumferentially about a main axis, and a turbine section, where exhaust hot gases produced in the combustor assembly are expanded to convert thermal and kinetic energy of the hot gas flow into mechanical energy. The can combustors are fluidly coupled to the turbine section through respective transition ducts, which are generally provided as tubular bodies having an upstream end at an outlet of the respective combustor can and a downstream end at an inlet of the turbine section. The transition ducts are configured to guide the hot gas flow from the combustor outlet to the turbine inlet and are thus exposed to extremely high temperatures. In some kinds of gas turbines, for example, the temperature of hot gas may reach 1800 K. As other components of gas turbines, also transition ducts therefore require cooling to avoid damages caused by overheating and to increase lifetime.

For the purpose of cooling the transition ducts, a relatively fresh airflow is usually taken from the compressor delivery air in a plenum around the combustors assembly. This cooling airflow is directed substantially perpendicularly to an outer surface of the transition duct in the form of impinging air jets that provide for cooling. Impinging air jets may be obtained by feeding the cooling airflow through cooling holes in a wall surrounding the transition duct at a distance.

Impingement cooling, however, is not free from limitations. In the first place, creating impinging jets by feeding air through the surrounding wall and against the outer surface of the transition duct causes a substantial pressure drop across the impingement cooling holes, on account of the fluidic resistance of the holes and turbulence created by impingement. The pressure drop thus results in a loss of efficiency of the gas turbine, because quite a large airflow needs to be subtracted from the overall airflow processed by the compressor in order to provide a given cooling effect.

Another limitation of impingement cooling resides in that it may be difficult to adequately cool the downstream portion of the transition duct, at the connection with the turbine section of the gas turbine engine. On the one side, the residual amount of air at the downstream end of the transition duct may be rather small, as most of the available airflow flows through the impingement cooling holes before reaching the connection with the turbine section. On the other side, the geometry of the downstream section and of the coupling members for connection with the turbine may be quite complex, so directing impinging air jets may be hardly feasible.

In addition, air supply is required all around the transition ducts, to provide impinging air jets also on the sides thereof.

Therefore, adjacent transition ducts need to be circumferentially spaced apart from one another to provide sufficient air passage between respective surrounding walls. This leads to quite bulky combustor assemblies and, even worse, to uneven hot gas flow into the turbine section between adjacent transition ducts.

SUMMARY OF THE INVENTION

It is an aim of the present invention is to provide a gas turbine transition duct which allows to overcome or at lease attenuate the limitations described.

According to the present invention, there is provided a gas turbine transition duct comprising:

an inner tubular body, defining a transition channel and having a first upstream end and a first downstream end for coupling to a can combustor and to a turbine section of a gas turbine assembly, respectively;

an outer tubular body, arranged around the inner tubular body and having a second upstream end at the first upstream end of the inner tubular body and a second downstream end at the first downstream end of the inner tubular body;

wherein a convective cooling channel is defined between the inner tubular body and the outer tubular body, the convective cooling channel having an inlet between the first downstream end and the second downstream end;

and wherein the outer tubular body is continuous between the second upstream end and the second downstream end.

The convective cooling flow may be smoothly guided into the cooling channel that is defined between the inner and outer tubular bodies avoiding corners and without creating turbulence and intersections of flow lines. Accordingly, substantial pressure drops are also avoided and efficiency of the gas turbine assembly is increased.

The cooling flow inlet is located at the downstream ends of the inner tubular body and outer tubular body and no cooling feed is required through the side wall of the outer tubular body. Therefore, there is no need to leave space between adjacent transition ducts than in excess to space required to accommodate thermal expansion of the outer bodies. This is not only beneficial to the overall dimension of the combustor assembly, but also allows to supply uniform and evenly distributed hot gas flow to the gas turbine. In fact, the transition ducts may be provided with broader outlets and the spacing between the outlets of adjacent transition ducts is reduced, thereby comparatively reducing flow changes at the border.

Another advantage of the invention resides in that also the downstream end of the inner tubular body and outer tubular body can be uniformly and effectively cooled, thus substantially reducing the risk of overheating of the components and increasing lifetime.

The cross-section of the cooling channel and the geometry of the inlet can be accurately controlled.

According to an aspect of the invention, the cooling channel is configured to convey a cooling flow along an outer surface of the inner tubular body from the first downstream end and second downstream end towards the first upstream end and second upstream end.

In use, hot gas produced by burning an air-fuel mixture in the combustor flow through the transition channel from the upstream end to the downstream end of the inner tubular body, while a cooling medium flows is in the opposite direction along the outer surface of the inner tubular body. Accordingly, a counter-flow heat exchange results, which is very efficient in cooling and in reducing losses.

According to an aspect of the invention, the cooling channel extends all around the inner tubular body, the inlet defines an inlet flow direction transverse to the outer surface of the inner tubular body at all sides of the inner tubular body and the inlet is configured to guide the cooling flow along the outer surface of the inner tubular body.

Smoothly guiding a fluid flow through an angle (from transverse to parallel to the outer surface of the inner tubular body) can be quite easily accomplished. Accordingly, the transverse inlet at all sides of the inner tubular body provides for sufficient supply of cooling fluid for the cooling channel without causing any major loss of pressure.

According to an aspect of the invention, the inner tubular body has a first frame at the first downstream end; the outer tubular body has a second frame at the second downstream end, the second frame being arranged parallel to and at a distance from the first frame; and the inlet of the convective cooling channel is defined between the first frame and the second frame.

The inlet between frames at the downstream ends of the inner tubular body and outer tubular body, which connect to the turbine section, favours effective cooling even of the terminal portion of the transition duct.

According to an aspect of the invention, the transition duct comprises a splitter in the inlet of the convective cooling channel.

The splitter helps guiding the cooling fluid, further reducing loss of pressure.

According to an aspect of the invention, the splitter comprises a third frame, arranged between the first frame and the second frame.

According to an aspect of the invention, the splitter has an edge bent to guide the cooling flow along the outer surface of the inner tubular body.

A simple and effective structure of the splitter is thus provided. More than one splitter may be provided, in accordance with the needs.

According to an aspect of the invention, the transition duct according comprises spacers between the first frame and the second frame, the spacers being set across the inlet of the convective cooling channel.

The spacers allow to accurately define the relative position of the first frame and of the second frame and, accordingly, also the geometry of the inlet of the cooling channel. Since the spacers are set across the cooling channel, they also benefit from the cooling action and are protected from overheating.

According to an aspect of the invention, the second frame is secured to the first frame by fasteners that extend through respective spacers.

In this manner, also fasteners are effectively cooled.

According to another aspect of the invention, there is provided a gas turbine assembly comprising:

a compressor section, extending along a main axis;

a plurality of can combustors circumferentially arranged about the main axis;

a turbine section;

at least one transition duct as above defined.

BRIEF DESCRIPTION OF THE DRAWINGS

The present invention will now be described with reference to the accompanying drawings, which show some non-limitative embodiment thereof, in which.

DETAILED DESCRIPTION OF EXEMPLARY EMBODIMENTS

Figure 1:
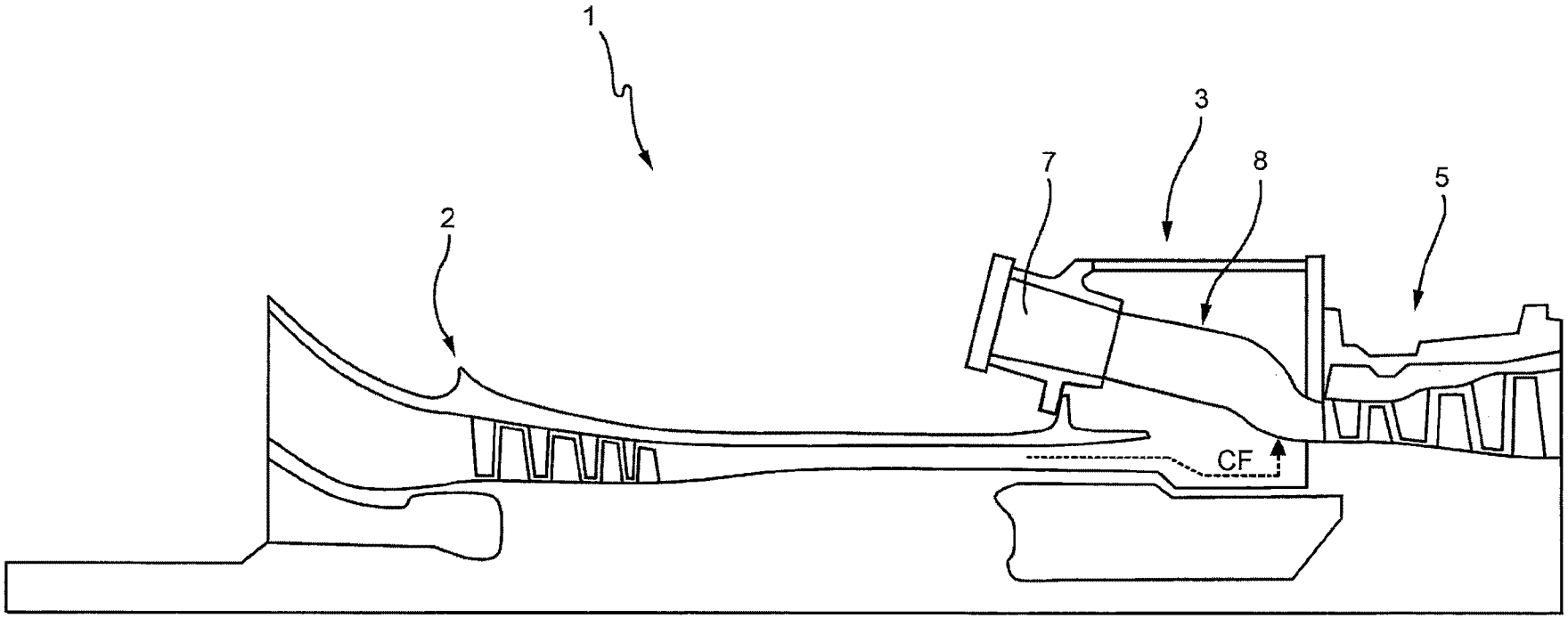
FIG. 1 is a side view, cut along an axial, longitudinal plane, of a gas turbine assembly.
Figure 2:
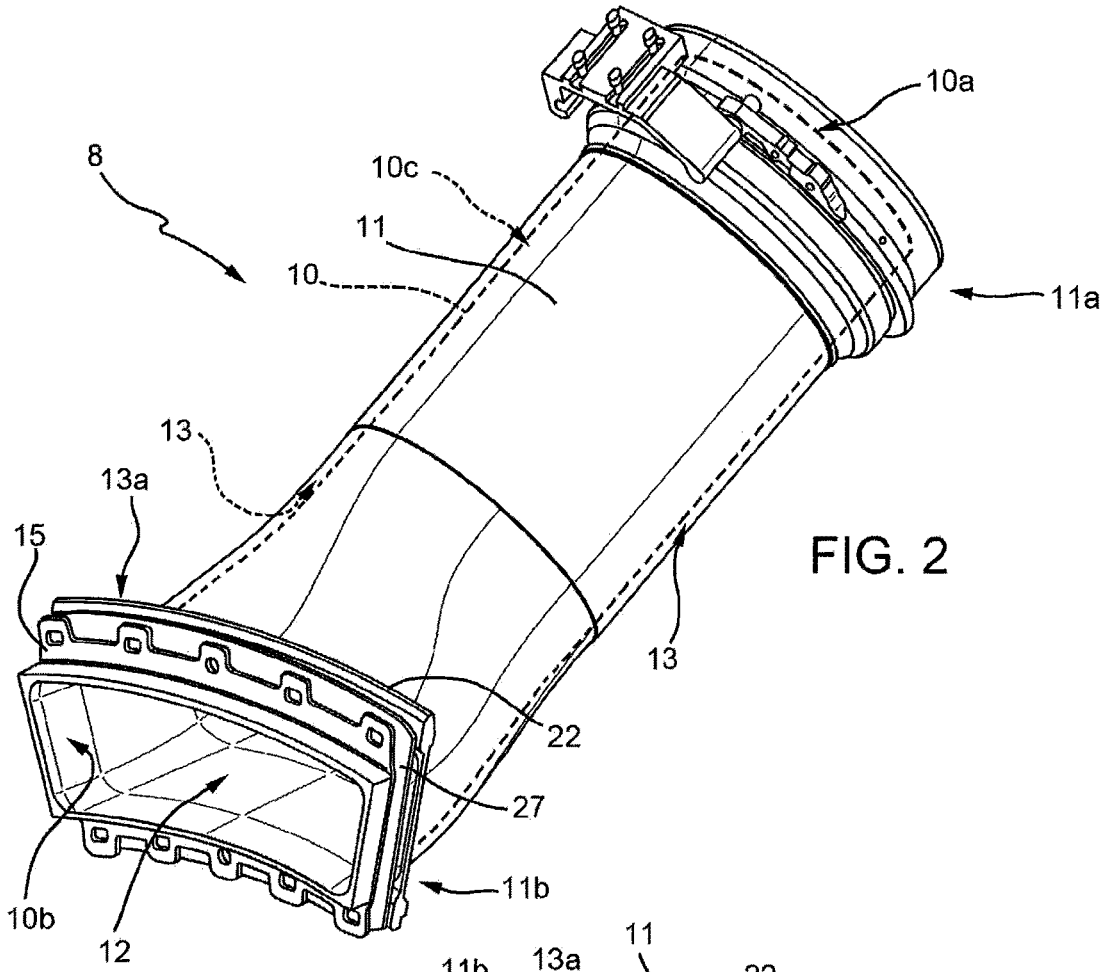
FIG. 2 is a perspective view of a transition duct in accordance with an embodiment of the present invention.
Figure 3:
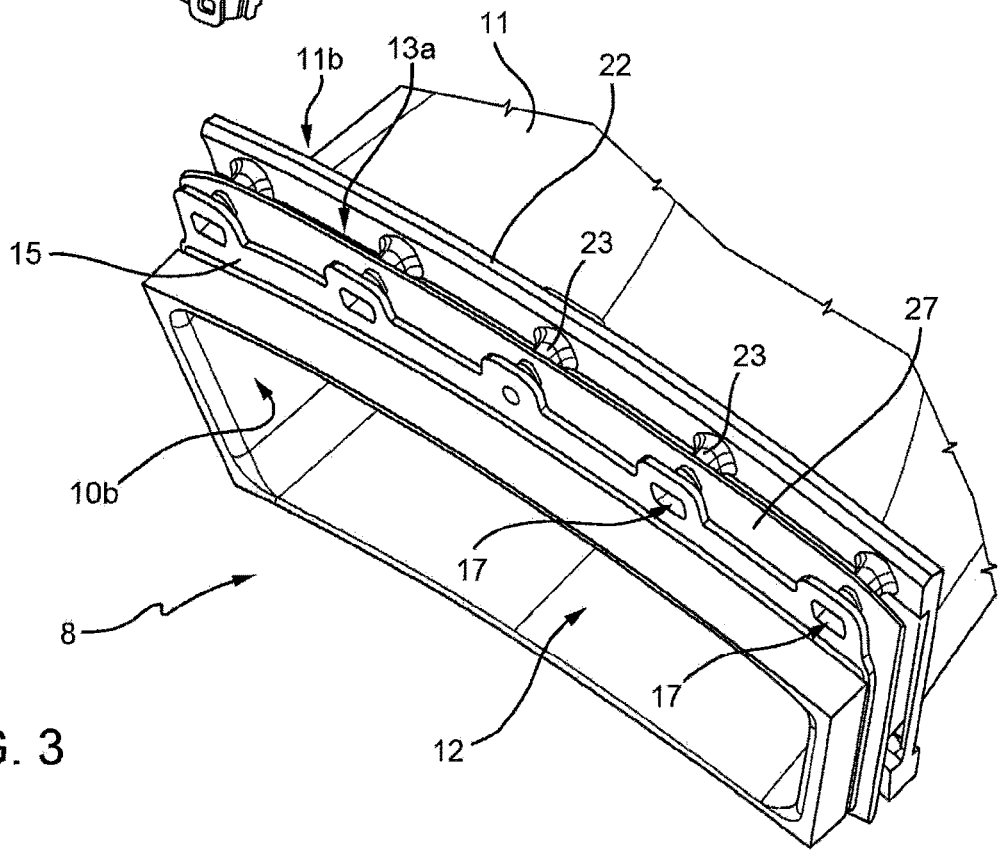
FIG. 3 is a perspective view of a detail of the transition duct of FIG. 2 on an enlarged scale.

FIG. 1 shows a simplified view of a gas turbine assembly, designated as whole with numeral 1. The gas turbine assembly 1 comprises a compressor section 2, a combustor assembly 3 and a turbine section 5. The compressor section 2 and the turbine section 5 extend along a main axis A. The combustor assembly 3 may be a single-stage combustor assembly or a sequential combustor assembly. In one embodiment, the combustor assembly 3 comprises a plurality of single-stage can combustors 7, circumferentially arranged about the main axis A.

The compressor section 3 of the gas turbine assembly 1 provides a compressed airflow, which is added with fuel and burned in the can combustors 7. The airflow delivered by the compressor section 2 is supplied to the combustor assembly 3 and to the turbine section 5 for the purpose of cooling.

In the combustor assembly 3, the can combustors 7 are coupled to the turbine section 5 through respective transition ducts 8.

As illustrated in FIGS. 2-5, a transition duct 8 according to one embodiment of the present invention comprises an inner tubular body 10 and an outer tubular body 11.

The inner tubular body 10 defines a transition channel that convey a hot gas flow from the respective can combustor 7 (upstream) to the turbine section 5 (downstream). More precisely, the inner tubular body 10 has an upstream end 10*a* coupled to the respective can combustor 7 and a downstream end 10*b* coupled to the turbine section 5 of the gas turbine assembly 1.

The outer tubular body 11 is arranged around the inner tubular body 10 and has an upstream end 11*a* in the vicinity of the upstream end 10*a* of the inner tubular body 10 and a second downstream end 11*b* in the vicinity the downstream end 10*b* of the inner tubular body 10. The outer tubular body 11 surrounds the inner tubular body 10 at a distance therefrom.

In one embodiment, the outer tubular body 11 is defined by a continuous wall that extends from the upstream end 11*a* to the downstream end 11*b* and passage of air across the continuous wall is prevented.

A convective cooling channel 13 thus is defined between the inner tubular body 10 and the outer tubular body 11. The convective cooling channel 13 has an inlet 13*a* between the downstream end 10*b* of the inner tubular 10 and the downstream end 11*b* of the outer tubular body 11, while an outlet is defined at the opposite upstream ends 10*a*, 11*a*. The convective cooling channel 13 extends all around the inner tubular body 10 and is configured to convey a cooling flow along an outer surface 10*c* of the inner tubular body from the downstream ends 10*b*, 11*b* towards the first upstream ends 10*a*, 11*a* of the inner tubular body 10 and outer tubular body 11 (see dashed arrow CF in FIG. 1, that shows, in a simplified manner, the cooling flow delivered by the compressor section 2 of the gas turbine assembly 1).

The inner tubular body 10 has a first frame 15 at its downstream end 10*b* for mechanical coupling to the turbine section 5. The first frame 15 is substantially perpendicular to the downstream end 10*b* of the inner tubular body 10 and is provided with lugs 17 for receiving fasteners 18, such as, but not limited to, nuts and bolts (see FIG. 4). In one embodiment, the first frame 15 is a separate component fitted to the downstream end 10*b* of the inner tubular body 10, with the interposition of a seal 20. The first frame 15 is set against a rib 21 that extends around the outer surface 10*c* of the inner tubular body 10. The rib 21 has a flat face against the first frame 15 and curved concave face, opposite to the flat face (see FIG. 4).

The outer tubular body 11 has a second frame 22 at its downstream end 11*b*. More precisely, the second frame 22 is integral to the outer tubular body 11 and is arranged parallel to and at a distance from the first frame 15. In one embodiment, spacers 23 are set between the first frame and the second frame 22 to accurately define the distance therebetween. The spacers 23 may be integral with the inner tubular body 10. The second frame 22 is secured to the first frame 15 by the fasteners 18 that extend through respective spacers 23 and engage respective lugs 17 of the first frame 15.

The inlet 13*a* of the convective cooling channel 13 is defined between the first frame 15 and the second frame 22. Therefore, the spacers 23 and the fasteners 18 are set across the inlet 13*a* of the convective cooling channel 13 and are immersed in the cooling flow CF entering the cooling channel 13.

Figure 4:
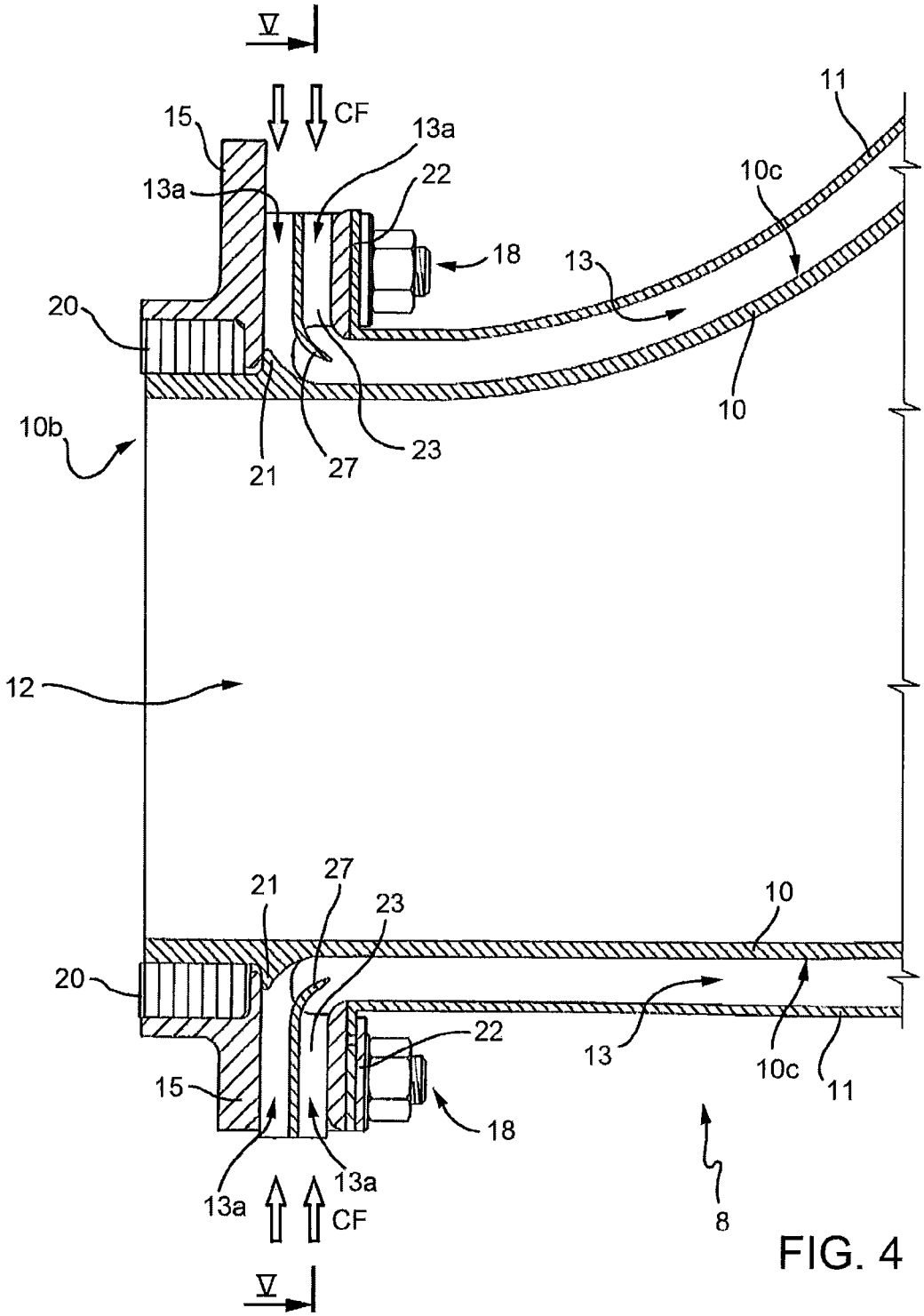
FIG. 4 is a side view, cut along an axial, longitudinal plane, of the transition duct of FIG. 2.
Figure 5:
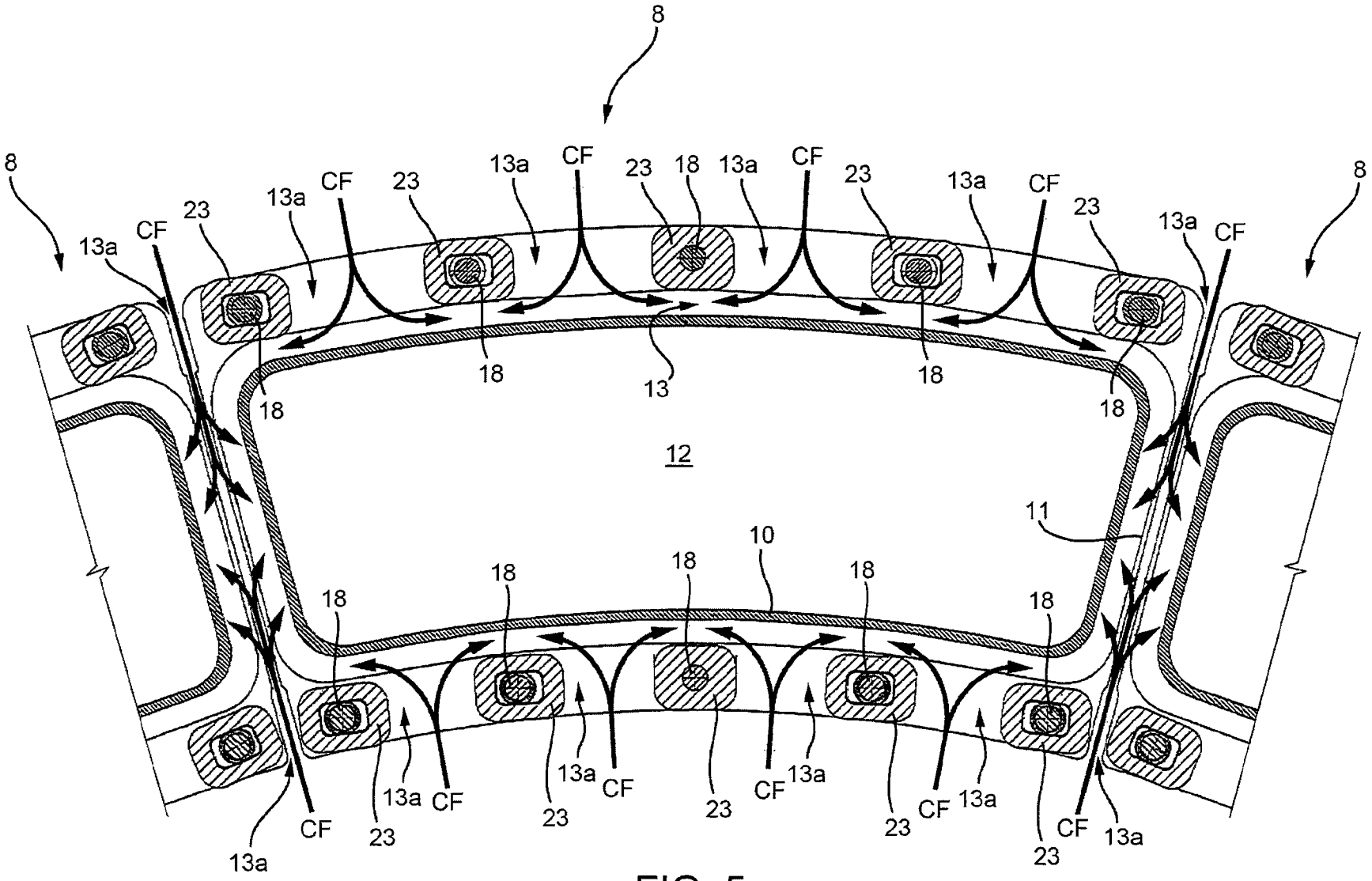
FIG. 5 is a front sectional view of the transition duct of FIG. 2, taken along the plane V-V of FIG. 4.

As illustrated in FIG. 4, the inlet 13*a* is defined all around the transition duct 8, so that a sufficient cooling flow CF be supplied to the convective cooling channel 13 from all sides. No cooling flow supply is required through the continuous wall defining the outer tubular body 11, in particular from sides facing adjacent transition ducts 8. Accordingly, adjacent transition ducts 8 may be arranged at a very close spacing from one another.

The inlet 13*a* of the cooling channel 13 defines, for the cooling flow CF, an inlet flow direction transverse to the outer surface 10*c* and is configured to steer the cooling flow CF along the outer surface 10*c* of the inner tubular body 10. Smooth steering of the cooling flow CF is favoured by the curved concave face of the rib 21, that delimits a portion of the inlet 13*a* of the cooling channel 13 and forms a turn without corners.

In one embodiment, the transition duct 1 comprises a splitter 27 in the inlet 13*a* of the convective cooling channel 13. The splitter 27 may be in the form of a third frame, arranged between the first frame 15 and the second frame 22 and has an inner edge 27*a* bent to steer the cooling flow CF along the outer surface 10*c* of the inner tubular body 10 from the inlet direction.

In some embodiments, not shown, the transition duct may comprise two or more splitters in the inlet of the cooling channel.

Figure 6:
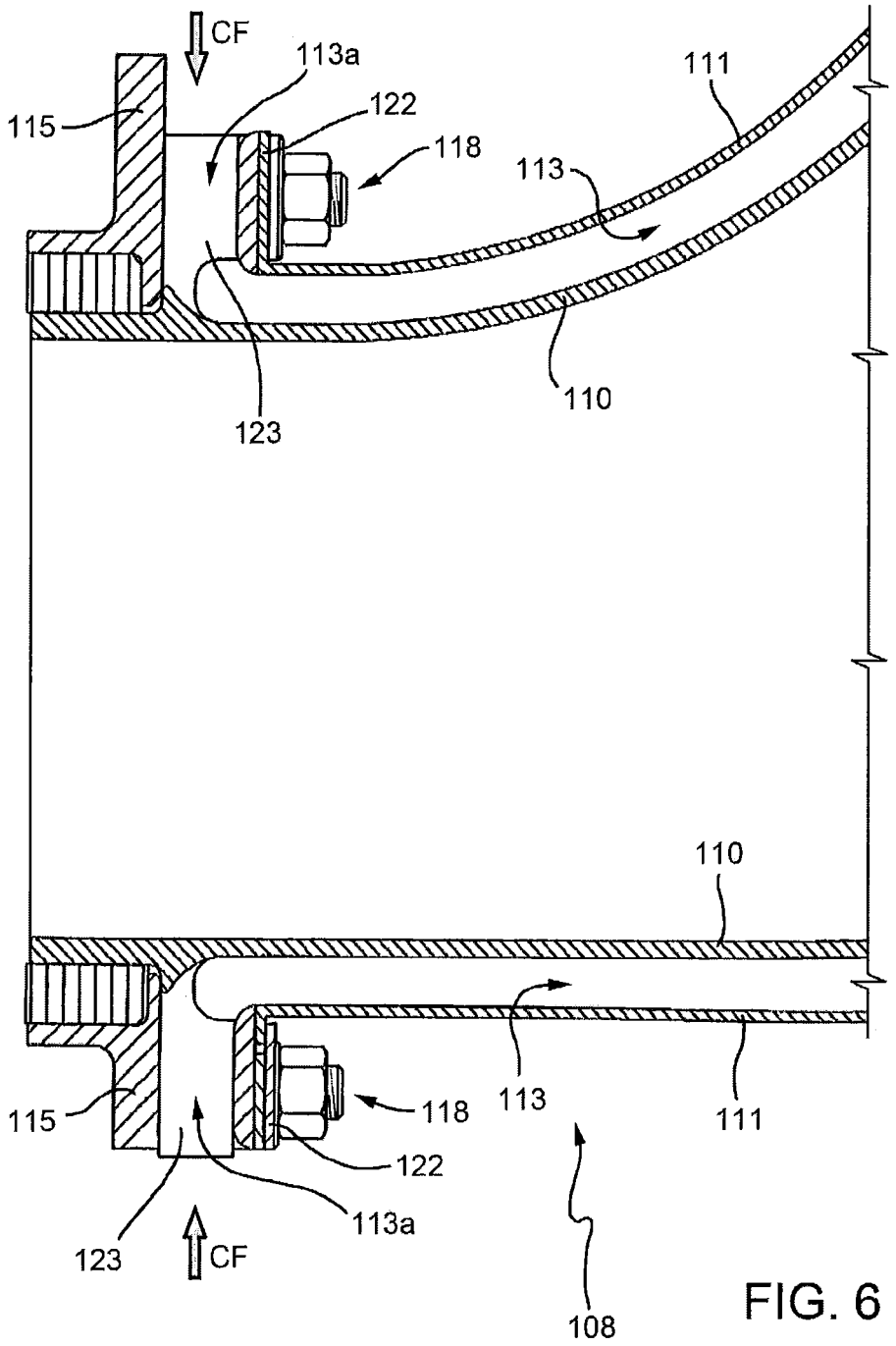
FIG. 6 is a side view, cut along an axial, longitudinal plane, of a transition duct according to another embodiment of the present invention.

The splitter however may not be present, as in the embodiment of FIG. 6. In this case, a transition duct 108 comprises an inner tubular body 110 and an outer tubular body 111, that is arranged around the inner tubular body 110 at a distances therefrom to form a convection cooling channel 113. An inlet 113*a* of the convection cooling channel 113 is defined at a downstream end of the transition duct 108 between a first frame 115, fitted to a downstream end of the inner tubular body 110, and a second frame 122, integral with the outer tubular body 111 and arranged parallel to and at a distance from the first frame 115. In this case, the inlet 113*a* of the is free, apart from spacers 123 and fasteners 118 which set and secure in their respective positions the first frame 115 and the second frame 122.

Finally, it is evident that the described transition duct may be subject to modifications and variations, without departing from the scope of the present invention, as defined in the appended claims.

The invention claimed is:

1. A gas turbine transition duct comprising:

an inner tubular body, defining a transition channel and having a first upstream end and a first downstream end for coupling to a can combustor and to a turbine section of a gas turbine assembly, respectively;

an outer tubular body, arranged around the inner tubular body and having a second upstream end at the first upstream end of the inner tubular body and a second downstream end at the first downstream end of the inner tubular body; wherein a convective cooling channel is defined between the inner tubular body and the outer tubular body, the convective cooling channel having an inlet between the first downstream end and the second downstream end; and wherein the outer tubular body is continuous between the second upstream end and the second downstream end, wherein the inner tubular body has i) an annular rib that extends in a radially outward direction, the annular rib having a flat face and on a side opposite the flat face, a curved concave face connected to the convective cooling channel for guiding a cooling flow to the convective cooling channel and ii) a portion that extends in a direction downstream of the annular rib; and iii) a first frame at the first downstream end, wherein the portion of the inner tubular body extends through the first frame such that the first frame abuts the flat face and surrounds said portion.

2. The transition duct according to claim 1, wherein the convective cooling channel is configured to convey the cooling flow along an outer surface of the inner tubular body from the first downstream end and second downstream end towards the first upstream end and second upstream end.

3. The transition duct according to claim 2, wherein the convective cooling channel extends all around the inner tubular body, the inlet defines an inlet flow direction transverse to the outer surface of the inner tubular body at all sides of the inner tubular body and the inlet is configured to guide the cooling flow along the outer surface of the inner tubular body.

4. The transition duct according to claim 2, wherein:

the outer tubular body has a second frame at the second downstream end, the second frame being arranged parallel to and at a distance from the first frame; and the inlet of the convective cooling channel is defined between the first frame and the second frame.

5. The transition duct according to claim 4, comprising:

a splitter in the inlet of the convective cooling channel.

6. The transition duct according to claim 5, wherein the splitter comprises:

a third frame, arranged between the first frame and the second frame.

7. The transition duct according to claim 5, wherein the splitter has an edge bent to guide the cooling flow along the outer surface of the inner tubular body.

8. The transition duct according to claim 4, comprising:

spacers between the first frame and the second frame, the spacers being set across the inlet of the convective cooling channel.

9. The transition duct according to claim 8, wherein the second frame is secured to the first frame by fasteners that extend through respective spacers.

10. A gas turbine assembly comprising:

a compressor section, extending along a main axis;

a plurality of can combustors, circumferentially arranged about the main axis;

a turbine section;

at least one transition duct according to claim 1.

* * * * *